United States Patent [19]

Kreibaum

[11] 4,337,810

[45] Jul. 6, 1982

[54] METHOD OF PRODUCING CUT TIMBER FROM ROUND TIMBER

[76] Inventor: Otto Kreibaum, Ortsteil Thüste, 3216 Salzhemmendorf 7, Fed. Rep. of Germany

[21] Appl. No.: 202,114

[22] Filed: Oct. 30, 1980

Related U.S. Application Data

[63] Continuation of Ser. No. 964,671, Nov. 29, 1978, abandoned.

[51] Int. Cl.[3] ..... B27B 1/00

[52] U.S. Cl. ..... 144/357; 144/39; 83/13

[58] Field of Search ..... 144/312, 39, 326; 83/13

[56] References Cited

U.S. PATENT DOCUMENTS

| | | | |
|---|---|---|---|
| 3,456,700 | 7/1969 | Ahlstedt | 144/312 |
| 3,487,866 | 1/1970 | Mitten | 144/312 |
| 3,554,249 | 1/1971 | Vasteras et al. | 144/312 |
| 3,738,404 | 6/1973 | Walker | 144/312 |
| 3,934,630 | 1/1976 | Cockle | 144/312 X |
| 3,968,822 | 7/1976 | Ottoson et al. | 144/312 |
| 4,069,851 | 1/1978 | Bibler | 144/312 |

FOREIGN PATENT DOCUMENTS

| | | | |
|---|---|---|---|
| 2750995 | 5/1979 | Fed. Rep. of Germany | 144/312 |
| 2050244 | 1/1981 | United Kingdom | 144/312 |

*Primary Examiner*—Donald R. Schran

*Attorney, Agent, or Firm*—Prutzman, Kalb, Chilton & Alix

[57] ABSTRACT

The present invention provides a method of producing cut timber from round timber comprising the steps of measuring the minimum diameter of each piece of round timber, sorting the round timber pieces and dividing them into groups of identical diameter, storing them in an intermediate storage device and feeding round timber pieces successively to a saw, which has been preset according to the diameter, for cutting timber sections, wherein the round timber logs to be processed are first cut to round timber pieces having a predetermined standard length, the minimum diameter is then measured on the individual round timber pieces, concentric, plane guide surfaces which are uniformly distributed over the periphery and spaced from each other at intervals depending on the measured diameter are provided, the round timber pieces are then sorted, and the round timber pieces are fed from the intermediate storage device to a cutter while being supported and guided by the guide surfaces, whereupon they are passed on for cutting into timber sections.

2 Claims, 1 Drawing Figure

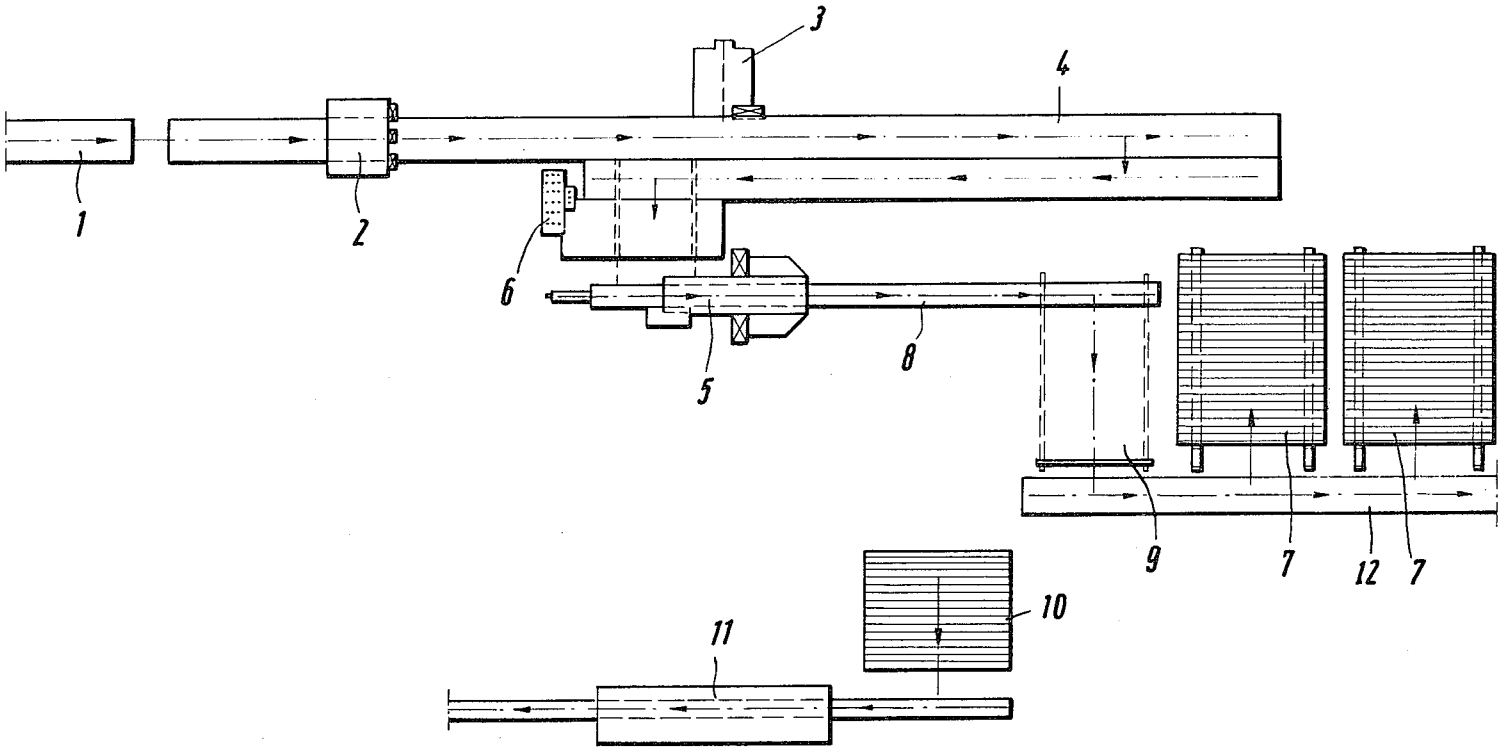
1
2
3
4
5
6
7
7
8
9
10
11
12

METHOD OF PRODUCING CUT TIMBER FROM ROUND TIMBER

This is a continuation of application Ser. No. 964,671, filed Nov. 29, 1978 now abandoned.

The invention relates to a method of producing cut timber from round timber in which the minimum diameter of each piece of round timber is measured, the round timber pieces being sorted and divided into groups of identical diameter. They are then intermediately stored, whereupon pieces of round timber of one group are successively fed to a saw (which is preset according to the diameter) for cutting the timber sections.

From the laid-upon German Specification No. 1503964 (paragraph 3 of the description) it is known to adjust saw blades of a saw frame so that at a specific log diameter they produce a maximum yield of timber. In order to avoid readjustment of the saw blades for each log, the logs are presorted and the logs having a diameter corresponding to the adjustment of the saw blades are fed consecutively through the plant. The presorting of round timber has the disadvantage of requiring large storage yards and costly means of transportation.

It is the aim of the invention to devise a method of the kind described at the outset in which the expenditure for storage yard, means of transportation and time is reduced and which permits extensive automation.

The solution according to the invention lies in that round timber logs are first cut to round timber pieces having a predetermined standard length in the order of 2 to 3 meters, that the minimum diameter is then measured on the individual round timber logs and concentric, plane guide surfaces distributed uniformly over the periphery and spaced from each other at intervals corresponding to the measured diameter are provided, that the round timber pieces are then sorted and that the round timber pieces are fed from the intermediate storage location to a cutter while being supported and guided by the guide surfaces, whereupon they are cut into circular shape and passed on for cutting into sections.

The method according to the invention makes it possible to feed unsorted logs. The space required for intermediate storage is reduced since not entire logs but only log sections must be stored. Because of the regular shape of the guide surfaces which are uniformly distributed over the periphery, these log sections can be stacked with a minimum of space required. Since the round timber diameter is measured when the guide surfaces are formed, the subsequent stacking in the intermediate storage yard can be automated easily. The removal of the round timber pieces from the intermediate storage place and feeding them to the processing machines is technically simple insofar as the machinery is concerned since owing to their uniform guide surfaces the round timber pieces are fairly uniformly stacked in the intermediate storage place and can be treated homogeneously.

From the U.S. Pat. No. 3,487,866 it is known to provide round timber with plane guide surfaces, which are uniformly distributed over the periphery, prior to sawing it into cut timber. However, no mention is made of a method of processing, which is characterized in that not only are guide surfaces provided but also in that round timber pieces of a specific standard length are cut first, that the logs are sorted after providing the guide surface and that they are intermediately stored according to the diameter prior to processing them further.

The invention will now be described in more detail, by way of example only, with reference to the accompanying drawings, in which the single FIGURE shows diagrammatically a plant for cutting timber.

The logs 1 arriving from a storage yard (which is not shown) are fed in the direction of the arrow through a debarking device 2 and then pass to a saw 3, in which they are cut into pieces 4 having a predetermined standard length. By means of a plurality of automatically operating conveyor, these pieces pass one at a time into a device 5, in which they are provided with guide surfaces according to their different diameters. They are provided for example, with guide grooves, plane surfaces or, if required, given a cylindrical shape for example, for guide surfaces may be distributed uniformly over the periphery over the timber pieces. Automatically operating devices which can perform this function are available. They comprise, for example, a scanning device for determining the diameter, a clamping device for clamping the piece of timber to be processed, the processing tools (saws, cutters) and devices for positioning these tools radially in accordance with the measured diameter. Arrangements can be made whereby these tools automatically followed the measured diameter, so that the end size of the guide surfaces corresponds to the measured diameter minus the processing depth. However, it is also possible to control the processing dimensions in stages so that identical processing sizes for all the diameters measured are obtained within specific size ranges.

The measured diameter is indicated on an indicator board 6. Corresponding to this indicated result the supervisor has the possibility of selecting the storage box into which the piece concerned is to be fed after processing. These boxes are at 7 downstream of an automatic conveyor 8, 9, 12 which delivers the conveyed piece to the preselected box 7. Each of these boxes thus contains a stock of preprocessed round timber pieces 4, all of which have either the same cross-sectional sizes or cross-sectional dimensions which lie within a narrowly defined range.

A crane (not shown) is provided. It can convey the round timber from a specific preselected box 7 to a device 10, which, for example, is designed as a chute in which the pieces are in the position for moving to a machine 11 for further processing. Of course, this crane can also be replaced by an automatic conveyor, which is selectively movable to a specific box similar to the conveyor 8, 9, 12.

The machine for further processing can be a series of cutters or saws which are adjusted to the cross-sectional size being processed at any given time and bring about an optimum cutting of this cross section. Thus, it is possible to feed these machine tools during a specific period of time of economic length with pieces having a specific diameter or a specific diameter group from one of the boxes 7.

After this period the tools are readjusted to another diameter group, which is taken from one of the other boxes.

Not only is the expenditure for personnel small in this plant but that for machines also is small since all the processing machines provided would have to be present if, as is known, all the log pieces would be preprocessed and distributed to one and the same minimum cross section.

In this plant planely processed surface portions of the logs are suitable for the guide surfaces, particularly for quadrangular preprocessing since these surfaces are in a lying position on the chute 10 so that at the end of the chute a defined position of the pieces for their transfer to the processing machine 11 can be assumed. A manual adjustment of the individual pieces on being transferred from the chute 10 to the guide devices of the processing machines thus is not required.

The embodiment of the invention in which an exclusive property or privilege is claimed are defined as follows:

1. A method of producing cut timber from round logs in a manner to increase the cut timber yield by increasing the average useable diameter of the logs, comprising the steps of precutting all of the round logs to the same predetermined substantially constant length with the said length being within the range of between two to three meters, measuring the minimum useable diameter of each precut log, providing longitudinal guide surfaces on the periphery of the precut logs for establishing a guide surface relationship for each log in accordance with narrow useable diameter ranges of their minimum useable diameters, sorting the logs in accordance with their said measured minimum useable diameter and dividing them into a plurality of groups of logs having useable diameters within said narrow useable diameter ranges respectively and the same guide surface relationship, separately storing the groups of logs, presetting a timber cutting saw for each group of logs in accordance with its useable diameter range and guide surface relationship to provide a predetermined optimum timber yield for the respective guide surface relationship, and cutting the logs of each group of logs in succession with the timber saw into timber sections with the saw preset for that group of logs while guiding each log for cutting with its longitudinal guide surfaces to provide said optimum timber yield.

2. A method of producing cut timber from round logs in a manner to increase the cut timber yield by increasing the average useable diameter of the logs, comprising the steps of precutting all of the round logs to the same predetermined substantially constant length with the said length being within the range of between two to three meters, measuring the minimum useable diameter of each precut log, providing longitudinal guide surfaces on the periphery of the precut logs for establishing a guide surface relationship for each log in accordance with narrow useable diameter ranges of their minimum useable diameters to provide the same guide surface relationship for all of the logs within each said narrow useable diameter range, sorting the precut logs in accordance with their said measured minimum useable diameter and dividing them into a plurality of groups of logs having useable diameters within said narrow useable diameter ranges respectively, separately storing the groups of logs, presetting a timber cutting saw for each group of logs in accordance with its useable diameter range and guide surface relationship to provide a predetermined optimum timber yield for the respective guide surface relationship, and cutting the logs of each group of logs in succession with the timber saw into timber sections with the saw preset for that group of logs while guiding each log for cutting with its longitudinal guide surfaces to provide said optimum timber yield.

* * * * *